US007980435B2

(12) United States Patent
Tages

(10) Patent No.: US 7,980,435 B2
(45) Date of Patent: Jul. 19, 2011

(54) ALL PLASTIC BELT OR STRAP CLIP FOR CELL PHONES AND PERSONAL ELECTRONIC DEVICES

(75) Inventor: Fernando Tages, Coral Springs, FL (US)

(73) Assignee: A.G. Findings & Manufacturing Company, Inc., Sunrise, FL (US)

( * ) Notice: Subject to any disclaimer, the term of this patent is extended or adjusted under 35 U.S.C. 154(b) by 981 days.

(21) Appl. No.: 11/157,098

(22) Filed: Jun. 20, 2005

(65) Prior Publication Data

US 2006/0283898 A1 Dec. 21, 2006

(51) Int. Cl.
*A45F 5/00* (2006.01)

(52) U.S. Cl. ..... 224/269; 224/666; 224/669; 224/930

(58) Field of Classification Search ..... 224/269, 224/197, 669, 930, 666, 3.11, 3.12, 3.13, 224/668, 242, 271; 248/309.1, 316.5, 316.7
See application file for complete search history.

(56) References Cited

U.S. PATENT DOCUMENTS 3,298,579 A * 1/1967 Smith ..... 224/183
4,083,481 A * 4/1978 Selinko ..... 224/670
5,597,102 A 1/1997 Saarikko et al. ..... 224/197
5,730,348 A * 3/1998 Tien ..... 224/669
5,778,497 A * 7/1998 Noda ..... 24/504
5,829,102 A * 11/1998 Conti ..... 24/3.12
5,850,996 A 12/1998 Liang ..... 248/221
6,141,417 A * 10/2000 Lopez et al. ..... 379/446
6,283,348 B1 9/2001 Wang ..... 224/271
6,626,336 B1 * 9/2003 Krusell ..... 224/271
6,955,279 B1 * 10/2005 Mudd et al. ..... 224/197
7,032,791 B2 * 4/2006 Stotts ..... 224/269

* cited by examiner

*Primary Examiner* — Justin M Larson
*Assistant Examiner* — Adam Waggenspack
(74) *Attorney, Agent, or Firm* — Robert C. Kain, Jr.

(57) ABSTRACT

The belt or strap clip includes a main body and a clip arm. The main body is adapted to retain, via a button mount, a cellular telephone or other personal electronic device. A plastic leaf spring has a fore end mounted to the main body, a curvaceous mid-section and an elongated leg member. The leg has a proximal pivot member and the distal leg region is disposed in a capture channel in the clip arm. A complementary pivot member in the clip arm coacts with the proximal pivot member such that when the main body pivots with respect to the clip arm, the elongated leg member bows. The method includes capturing the distal end of the spring into the clip arm and permitting the elongated leg to bow inboard during the pivot between the clip body and the clip arm.

18 Claims, 4 Drawing Sheets

10
16
13
11
B

24
A'
12
28
22
30
26
A''

15
17
14

19
17
14

19
15

FIG. 2
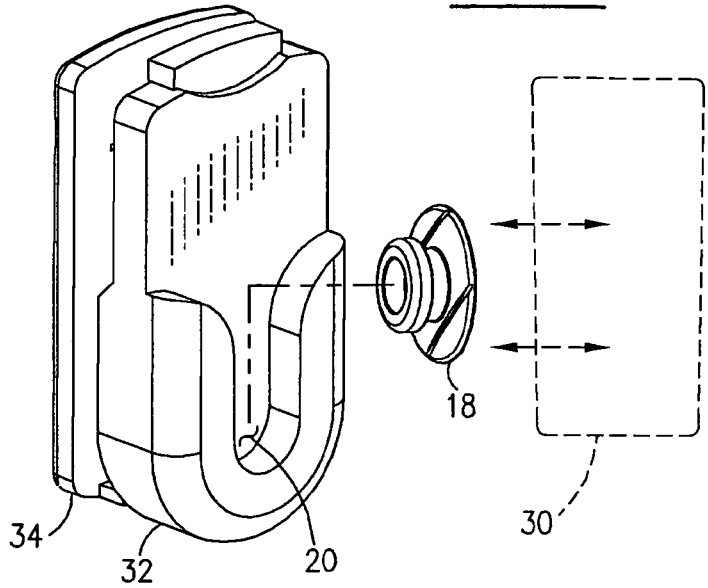
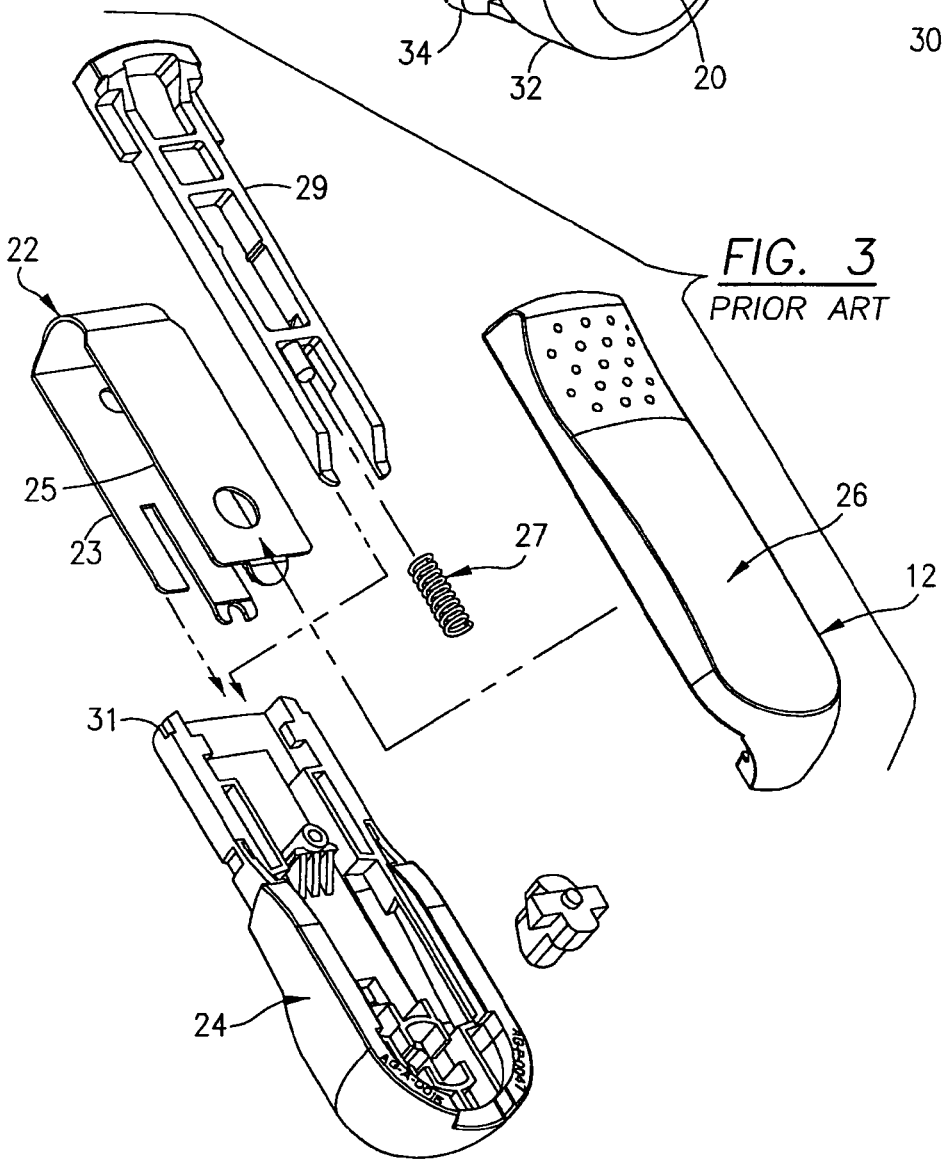
FIG. 3
PRIOR ART

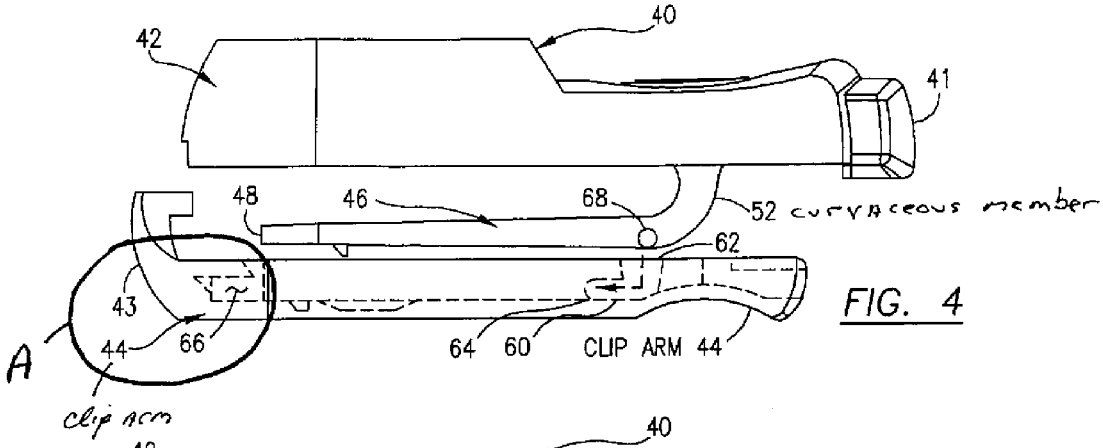
FIG. 4
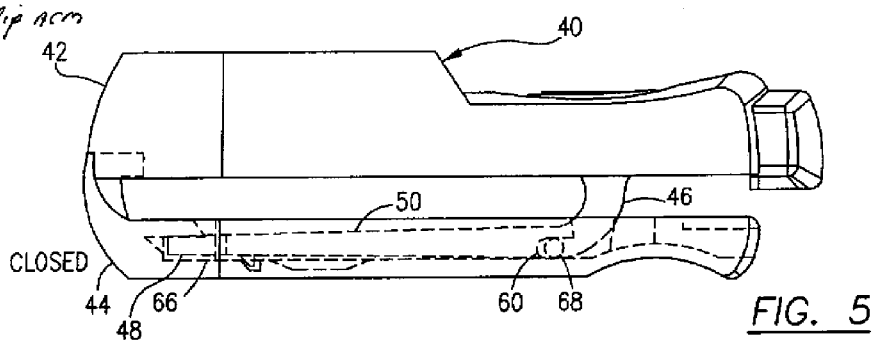
FIG. 5
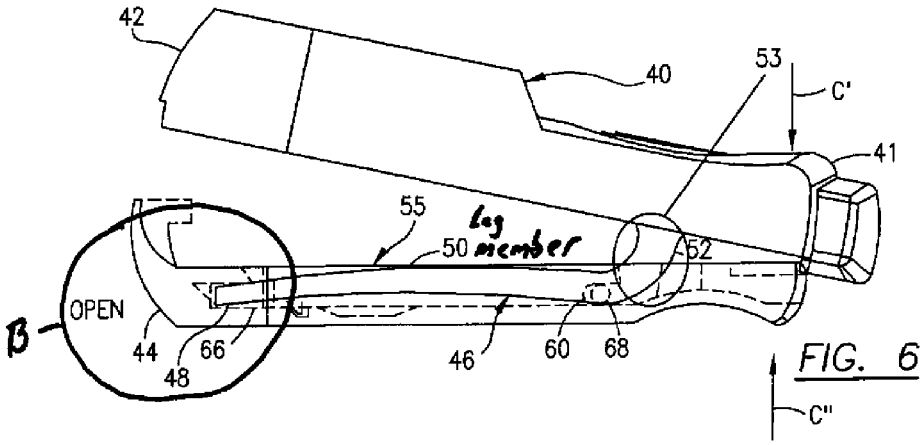
FIG. 6
FIG. 7
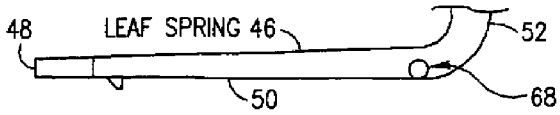

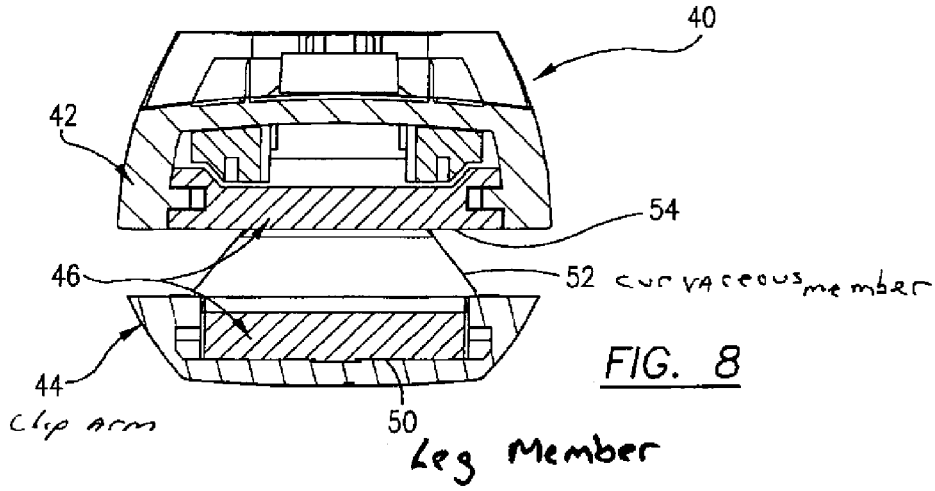
FIG. 8
FIG. 9
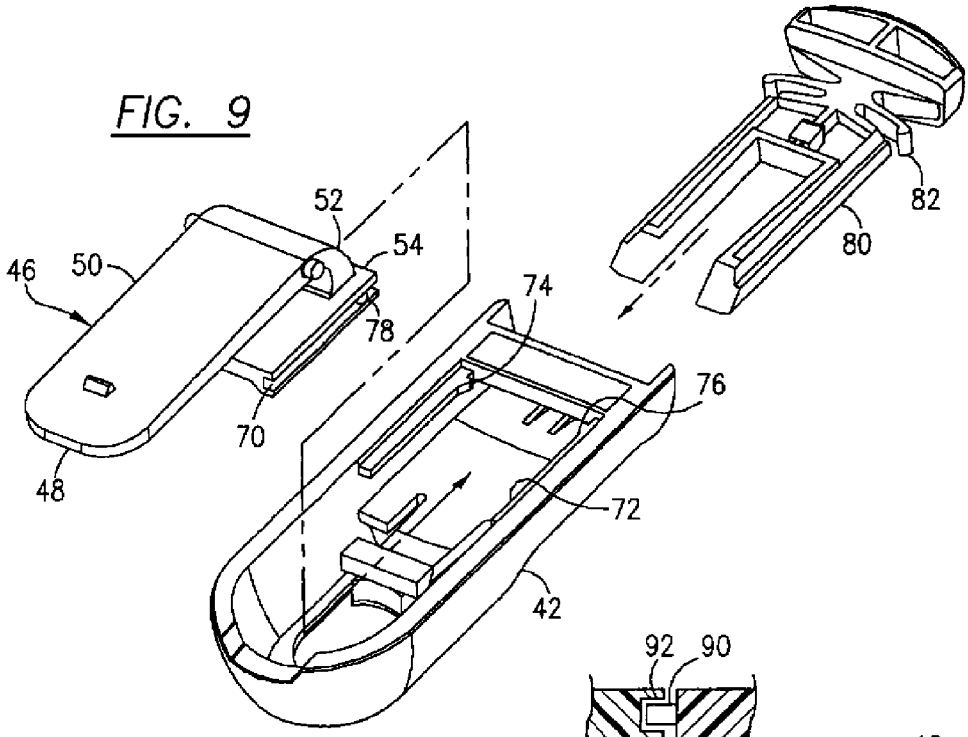
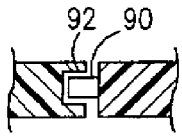
FIG. 10A
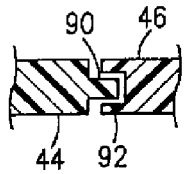
FIG. 10B

ALL PLASTIC BELT OR STRAP CLIP FOR CELL PHONES AND PERSONAL ELECTRONIC DEVICES

The present invention relates to an all plastic belt or strap clip which removably retains a cell phone or other personal electronic device (personal digital assistant, MP3 music player, Ipod, blackberry, etc.) thereon and a method to removably retain a cell phone or a personal electronic device.

BACKGROUND OF THE INVENTION

Many users of cell phones carry the cell phones on their belts or straps. Due to the decrease in size and weight of personal electronic devices, such as personal digital assistants, MP3 players, and small computers or communicators, these personal electronic devices can also be carried on a user's belt, purse strap, pant pocket or other belt-like structure. FIG. 1A diagrammatically illustrates a prior art belt or strap clip 10 which slips on the belt and FIGS. 1B, 1C and 1D diagrammatically illustrate prior art, "jaw style" clips 12 and 14. Some users prefer the jaw style clip of FIGS. 1B-1D because it provides better retaining characteristics and capture of the user's belt, or purse strap thereby preventing the loss of expensive cell phones and personal electronic devices. In FIG. 1A, main body unit 16 is adapted to be removably attached to the cell phone or personal electronic device 30 via button 18 shown in FIG. 2. Button 18 is attached to a cell phone or personal electronic device 30 and button 18 slides in and out of receiving passage 20 formed by body unit 16 and is releaseably locked or latched in receiving passage 20. The following patents describe prior art releasable button mounts: U.S. Pat. No. 5,597,102 to Saarikko (issued Jan. 28, 1997); U.S. Pat. No. 5,850,996 to Liang (issued Dec. 22, 1998) and U.S. Pat. No. 6,283,348 to Wang (issued Sep. 4, 2001).

FIG. 1B shows a prior art clip 12 with a metal leaf spring 22 having one end mounted to main body 24 and another end mounted to clip arm 26. Distal end regions 28, 30 of main body 24 and clip arm 26, respectively, form the "teeth" of the jaw and these teeth open and close based upon the user compressing the proximal end regions of both or either of main body 10 and clip arm 26 has shown by arrows A'-A".

Prior art clip in FIG. 1A is made entirely of plastic and arm 11 opens passageway 13 based upon a force applied in direction B at the distal end of clip 10. The force opens the passageway 13.

FIGS. 1C and 1D also show an all plastic clip wherein the spring member 15 is U-shaped with one leg of the U attached to main body 17 and the other leg of the U attached to clip arm 19.

FIG. 3 diagrammatically illustrates another prior art design showing a metal leaf spring 22 having one leg 23 mounted into main body 24 and the other leg 25 mounted in clip arm 26. A plunger actuator 29 is biased outboard with respect to proximal end 31 of main body 24 via a metallic spring 27. Therefore, although many components of the prior art belt clip 12 are plastic (main body 24, clip arm 26 and plunger/actuator 29), two major components such as leaf spring 22 and bias spring 27 are metal. There is a growing need to eliminate all metal components in these belt clips due to the metal's adverse effect on the specific absorption rate (SAR) of radio frequency (RF) energy emitted by the cell phone and potentially directed into the user's body. More specifically, the metal may, in some rare occasions, focus or re-transmit or re-direct the radio frequency energy from the cell phone such that the energy effects the user's body. Presently, Federal Communications Commission (FCC) has regulations which limit specific absorption rates for cellular telephones when such cellular telephones are worn on the body of the user. The same is true regarding personal electronic devices. It is well established that an all plastic belt or strap clip does not have an adverse effect on specific absorption rate of the RF signal and therefore is potentially completely exempt from FCC regulations.

The problem with all plastic prior art jaw type belt clips (shown in FIGS. 1C and 1D) is that the small U-shaped spring member 15 fails prematurely and almost instantly because prior art all plastic designs were adopted from the very simple metal spring design (FIG. 1B) and just involve replacing the metal spring with a plastic spring. This adaptation of plastic from metal in the spring member, is fatal since plastic yields at much lower stress levels than metal and also has considerably lower strength than metal. The required geometry and relative proportions of a comparable all plastic spring are much different and larger than that of a similarly sized metal spring.

OBJECTS OF THE INVENTION

It is an object of the present invention to provide a belt or strap clip for a cellular telephone or personal electronic device which is all plastic.

It is another object of the present invention to provide a belt clip which provides a plastic leaf spring which is strong, robust, and permits an easy mounting and an interface between the main body and the clip arm.

It is a further object of the present invention to provide a method for pinching a belt or strap between a clip body and a clip arm by permitting the plastic leaf spring to bow at a region between a proximal pivot and a distal captured end.

SUMMARY OF THE INVENTION

The belt or strap clip includes a main body adapted to mount, retain and carry a cellular telephone or other personal electronic device and a clip arm. A plastic leaf spring is formed as a hook with a fore end, a curvaceous mid-section and an elongated leg member. The fore end of the plastic spring is mounted to the main body. The leg member of the plastic spring has a proximal pivot member and a distal leg edge, surface or region. The clip arm has a capture channel for the distal leg region and a complementary pivot member coacting with a proximal pivot member on the plastic spring such that when the main body pivots with respect to the clip arm about the pivot members, the elongated leg member bows. The method includes capturing the distal end of the spring into the clip arm and permitting the elongated leg to bow during the pivot between the clip body and the clip arm.

BRIEF DESCRIPTION OF THE DRAWINGS

Further objects and advantages of the present invention can be found in the detailed description of the preferred embodiments when taken in conjunction with the accompanying drawings in which:

FIGS. 1A, 1B, 1C, 1D and 3 diagrammatically illustrate prior art devices;

FIG. 2 diagrammatically illustrates the button retaining connection between the belt or strap clip and the cell phone or other personal electronic device;

FIG. 4 diagrammatically illustrates the belt or strap clip in a partially disassembled mode;

FIGS. 5 and 6 diagrammatically illustrate the belt or strap clip in a closed and a opened position, respectively;

FIG. 7 diagrammatically illustrates a portion of the plastic leaf spring;

FIG. 8 diagrammatically illustrates a partial, cross-sectional view of the belt clip;

FIG. 9 diagrammatically illustrates the leaf spring and main body and plastic actuator plunger in a partially disassembled mode; and FIGS. 10A and 10B diagrammatically illustrate various pivot member configurations.

DETAILED DESCRIPTION OF THE PREFERRED EMBODIMENTS

Figures 1A, 1B, 1C, 1D:
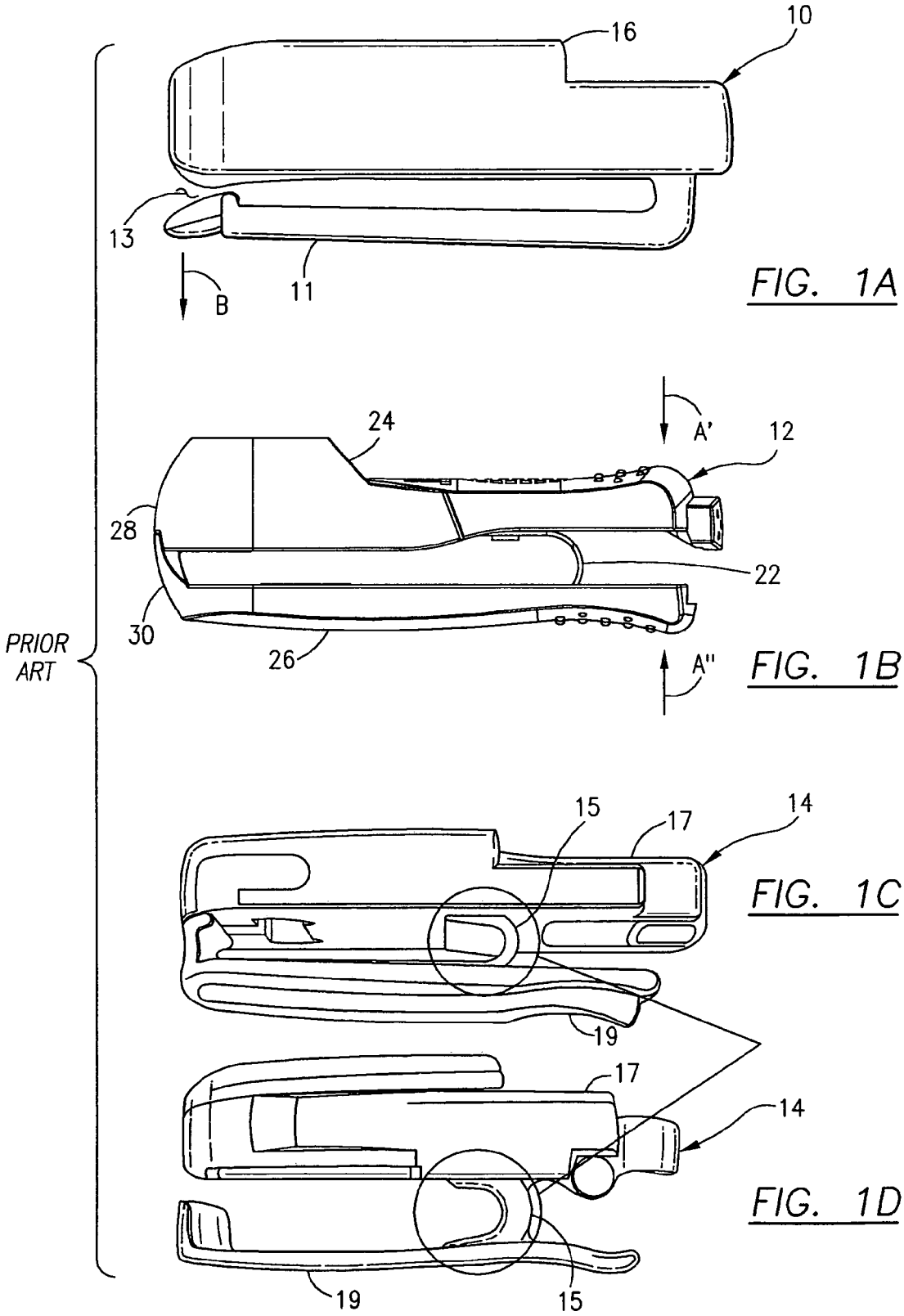
FIG. 1B PRIOR ART

The present invention relates to a plastic belt or strap clip for a cellular telephone or other personal electronic device. A method is also disclosed.

FIG. 2 diagrammatically illustrates that button 18 which is semi-permanently attached or fixed to cell phone or other personal electronic device 30. Button attachment 18 slides into receiving area 20 of main body 32. Main body 32 has, pivotally attached thereto via some type of spring, a clip arm 34. The drawing does not illustrate the "clip-on" mechanism which may consist of the prior art clips or may embody the new clip subject to this patent application.

FIG. 4 diagrammatically illustrates an all plastic belt or strap clip 40 having main body 42 and clip arm 44 and plastic leaf spring 46. Reference will be made herein to a "belt clip" but it should be noted that the clip can be used on any belt, strap, pant edge (which incorporates a belt-type structure) or ribbon structure. Similar numerals designate similar items throughout the drawings. Clip 40 has a proximal end 41 and a distal end 43. Therefore, plastic leaf spring 46 has a distal leg edge 48, an elongated leg member 50, a curvaceous section 52 and a fore end 54 (shown in FIG. 9 but not illustrated in FIGS. 4-7). Clip arm 44 has a number of channels or capture members, one of which is L-shaped channel 60 having an open end 62 and a channel leg 64. Channel leg 64 leads distally toward distal end of clip 40. Open end 62 is open to the main body. Clip arm 44 also includes a U-shaped capture channel 66 adapted to capture distal leg edge 48 or a distal region of the leg 50.

In the preferred embodiment, plastic leaf spring 46 is hook shaped and includes a pivot pin or journal 68 which coacts with complementary pivot member 60 such that channel 60 is a bearing member. Alternatively, as discussed later in conjunction with FIGS. 10A and 10B, the clip arm 44 may include the pivot pin and the plastic leaf spring 46 may include the complementary pivot member.

FIG. 5 shows clip arm 44 which is closed with respect to main body 42. Distal end 48 of leaf spring 46 is positioned in capture channel 66. As shown in FIGS. 4-6, capture channel 66 has two sides and a bottom connected together and an opening which is open in the direction of curvaceous section 52 such that capture channel 66 adapted to capture distal leg edge 48 or a distal region of the leg 50. Further, proximal pivot member 68 is disposed in complementary pivot member 60. This is accomplished by first placing main body 42 in a direction towards clip arm 44 such that the proximal pivot member 68 enters opening 62 of channel 60. Thereafter, main body 42 is moved distally with respect to the stationary clip arm 44 such that the proximal pivot member 68 moves distally into channel leg 64. At the same time, distal end 48 of plastic leaf spring 46 moves distally into capture channel 66. Of course, rather than have end 48 disposed in capture channel 66, a side region near distal end 48 of leaf spring 46 could be placed into capture side pockets of clip arm 44. Both systems retain the distal region of the leaf spring in the distal region of the clip arm.

FIG. 6 diagrammatically shows main body 42 pivoting open with respect to stationary clip arm 44 due to a force C'-C" at proximal end 41 of belt or strap clip 40. The user applies force C'-C" on actuation surfaces. Plastic leaf spring 46 is placed under torsion or longitudinal bending stress and a portion thereof pivots and flexes open at curvaceous member 52. Plastic leaf spring 46 therefore is stressed at curvaceous member region 53 and is also stressed along elongated leg member 50. Member 50 bows inboard towards main body 42 along its longitudinal length 55 during the pivoting action of main body 42 with respect to clip arm 44. Further, distal end 48 may move within capture channel 66. The torsional force is distributed over curve 53 and leg 50.

FIG. 7 shows leaf spring 46, elongated leg member 50, proximal pivot member 68, curvaceous mid-section 52 and distal end or edge region 48.

FIG. 8 diagrammatically shows a partial, cross-sectional view of belt clip 40. Plastic leaf spring 46 is shown and leg member 50 is movably retained for pivotal movement within clip arm 44 and fore end 54 is shown mounted in main body 42.

FIG. 9 diagrammatically illustrates plastic leaf 46 having distal end, edge or end region 48, elongated leg body 50, curvaceous member 52 and fore end 54. FIG. 9 shows that plastic leaf spring 46 is generally formed as a hook. Fore end 54 has a mounting system which permits mounting into main body 42. In the illustrated embodiment, fore end 54 includes a pair of longitudinal grooves, one of which is groove 70 which coacts with a tongue 72. Opposing tongues are formed in the main body 42. The opposite side (not shown in FIG. 9) includes a similar tongue and groove attachment mechanism. At the proximal end of this tongue and groove system, a set of protruding tabs 74 and 76 coact with a locking tab or locking channel 78. Plastic actuator plunger 80 includes a plastic biasing member 82. Actuating member 80 is depressed in a distal direction in order to release the button release mechanism to release button 18. See FIG. 2.

FIGS. 10A and 10B diagrammatically show that the pivot pin 90 placed in journal 92 may be reversed such that pivot pin 90 protrudes from clip arm 44 and journal 92 is configured in plastic leaf spring 46. The same is true regarding the tongue and groove configuration mounting plastic leaf spring 46, and, more particularly, fore end 74 into main body 42. Other mounts and pivot systems may be utilized.

As shown in FIG. 6, in order to open the clip arm from the clip body, the user depresses the user actuation surfaces and applies force C'-C" at the proximal end of the belt clip 40. The distal end 43 of the belt clip opens thereby permitting the user to insert and hence capture the belt or strap in the open jaws of the belt clip.

The claims appended hereto are meant to cover modifications and changes within the scope and spirit of the present invention.

What is claimed is:

1. A clip for a cellular telephone or a personal electronic device comprising:

a main body adapted to removably retain and carry said cellular telephone or personal electronic device;

a plastic leaf spring formed as a hook with a fore end, a curvaceous mid-section and an elongated leg member, said fore end mounted to said main body, said leg member having a proximal pivot member and a distal leg mount; and a clip arm having a capture member for said distal leg mount and a complementary pivot member coacting with said proximal pivot member such that said main body pivots with respect to said clip arm there at;

wherein said proximal pivot member is a pin and said complimentary pivot member is an L-shaped channel open towards said main body having a channel leg oriented in a longitudinal direction with said capture channel such that pin and said distal leg edge move longitudinally during mounting within said channel leg and said capture channel.

2. A clip for a cellular telephone or a personal electronic device comprising:

a main body adapted to removably retain and carry said cellular telephone or personal electronic device;

a plastic leaf spring formed as a hook with a fore end, a curvaceous mid-section and an elongated leg member, said fore end mounted to said main body, said leg member having a proximal pivot member and a distal leg mount; and a clip arm having a capture member for said distal leg edge and a complementary pivot member coacting with said proximal pivot member such that said main body pivots with respect to said clip arm thereat said elongated leg member bows;

wherein said proximal pivot member is a pin and said complementary pivot member is an L-shaped channel open towards said main body having a channel leg oriented in a longitudinal direction with said capture channel such that pin and said distal leg edge move longitudinally during mounting within said channel leg and said capture channel.

3. A clip for a cellular telephone or a personal electronic device comprising:

a main body adapted to removably retain and carry said cellular telephone or personal electronic device;

a plastic leaf spring formed as a hook with a fore end, a curvaceous mid-section and an elongated leg member, said fore end mounted to said main body, said leg member having a proximal pivot member and a distal leg mount; and a plastic clip arm having a capture member for said distal leg edge and a complementary pivot member coacting with said proximal pivot member such that said main body pivots with respect to said clip arm thereat said elongated leg member bows;

wherein said leaf spring includes a base, said base attached to said fore end of said hook, said base mounted to said main body with a tounge and groove fitting;

wherein said proximal pivot member is a pin and said complementary pivot member is an L-shaped channel open towards said main body having a channel leg oriented in a longitudinal direction with said capture channel such that pin and said distal leg edge move longitudinally during mounting within said channel leg and said capture channel.

4. A clip as claimed in claim 3 wherein said elongated leg and said curvaceous mid-section are under stress when said main body pivots with respect to said clip arm.

5. A clip as claimed in claim 4 wherein said clip arm includes an exposed rear wall defining in part a user actuation surface.

6. A clip as claimed in claim 5 wherein said user actuation surface is opposite said capture channel with respect to said complementary pivot member.

7. A clip as claimed in claim 6 wherein the entire belt clip is plastic.

8. A clip as claimed in claim 2 wherein said proximal pivot member is a pivot pin and said complimentary pivot member is a bearing for said pivot pin.

9. A clip as claimed in claim 8 wherein said leg member has two pivot pins transverse to said elongated leg member and said clip arm has a respective bearing for said two pivot pins.

10. A clip as claimed in claim 2 wherein said capture channel permits said fore end to move in said channel when said clip arm pivots with respect to said main body.

11. A clip as claimed in claim 2 wherein said leaf spring includes a base, said base attached to said fore end of said hook, said base mounted to said main body with a tongue and groove fitting.

12. A clip as claimed in claim 2 wherein said proximal pivot member is a pin and said complementary pivot member is an L-shaped channel open towards said main body having a channel leg oriented in a longitudinal direction with said capture channel such that pin and said distal leg edge move longitudinally during mounting within said channel leg and said capture channel.

13. A clip as claimed in claim 2 wherein said elongated leg and said curvaceous mid-section are under stress when said main body pivots with respect to said clip arm.

14. A clip as claimed in claim 2 wherein said clip arm includes an exposed rear wall defining in part a user actuation surface.

15. A clip as claimed in claim 14 wherein said user actuation surface is opposite said capture channel with respect to said complementary pivot member.

16. A clip as claimed in claim 2 wherein the entire belt clip is plastic.

17. A clip as claimed in claim 9 wherein said capture channel permits said fore end to move in said capture member when said clip arm pivots with respect to said main body.

18. A clip as claimed in claim 17 wherein said leaf spring includes a base, said base attached to said fore end of said hook, said base mounted to said main body with a tongue and groove fitting.

* * * * *